US008079926B2

(12) United States Patent
Mackey, Jr. et al.

(10) Patent No.: US 8,079,926 B2
(45) Date of Patent: Dec. 20, 2011

(54) REAR MOUNTABLE CUTTER DEVICE FOR A HUNTING ARROW

(75) Inventors: James F. Mackey, Jr., Tewksbury, MA (US); Joseph M. Camara, Salem, NH (US)

(73) Assignee: Shawsheen River Archery Products, LLC, Salem, NH (US)

( * ) Notice: Subject to any disclaimer, the term of this patent is extended or adjusted under 35 U.S.C. 154(b) by 220 days.

(21) Appl. No.: 12/570,558

(22) Filed: Sep. 30, 2009

(65) Prior Publication Data

US 2010/0087283 A1 Apr. 8, 2010

Related U.S. Application Data

(60) Provisional application No. 61/194,980, filed on Oct. 2, 2008.

(51) Int. Cl.
*F42B 6/04* (2006.01)

(52) U.S. Cl. ..... 473/586; 473/578

(58) Field of Classification Search ..... 473/578, 473/582, 583, 584, 585, 586
See application file for complete search history.

(56) References Cited

U.S. PATENT DOCUMENTS

| | | | | |
|---|---|---|---|---|
| 3,790,948 | A | 2/1974 | Ratkovich | |
| 4,488,728 | A | 12/1984 | Humphrey | |
| 4,675,683 | A | 6/1987 | Robinson et al. | |
| 4,749,198 | A | 6/1988 | Brailean | |
| 4,858,935 | A | 8/1989 | Capson | |
| 4,885,800 | A | 12/1989 | Ragle | |
| 4,940,245 | A | 7/1990 | Bittle, Jr. | |
| RE33,470 | E | 12/1990 | Boy et al. | |
| 4,976,442 | A | 12/1990 | Treadway | |
| 5,022,658 | A * | 6/1991 | Burkhart | 473/578 |
| 5,157,405 | A | 10/1992 | Wycoff et al. | |
| 5,167,417 | A | 12/1992 | Stacey et al. | |
| 5,188,373 | A | 2/1993 | Ferguson et al. | |
| 5,427,384 | A * | 6/1995 | Saunders | 473/578 |
| 5,450,614 | A | 9/1995 | Rodriguez | |
| 6,409,617 | B1 | 6/2002 | Armold | |
| 6,612,947 | B2 | 9/2003 | Porter | |
| 6,814,678 | B2 * | 11/2004 | Cyr et al. | 473/578 |
| 6,856,250 | B2 | 2/2005 | Hilliard | |
| 7,232,389 | B2 | 6/2007 | Monteleone | |
| 7,300,367 | B1 | 11/2007 | Andol et al. | |
| 7,632,199 | B2 * | 12/2009 | Kikos | 473/578 |
| 7,909,714 | B2 * | 3/2011 | Cyr et al. | 473/578 |

(Continued)

OTHER PUBLICATIONS

Photo of Shrink Fletch Packaging, product available prior to Oct. 2, 2008.

(Continued)

*Primary Examiner* — John Ricci
(74) *Attorney, Agent, or Firm* — Weingarten, Schurgin, Gagnebin & Lebovici LLP

(57) ABSTRACT

A rear mountable cutter device for a hunting arrow is mountable to an arrow shaft. The device includes a plurality of elongated cutting members that are positioned along the rear end of the arrow shaft following mounting of the cutter device to the shaft. The cutting members are configured such that when the forward end of the cutting members engage a target animal, the cutting members deflect outward of the shaft to produce an enlarged wound in the target animal.

43 Claims, 4 Drawing Sheets

U.S. PATENT DOCUMENTS

| | | | |
|---|---|---|---|
| 2002/0091023 | A1 | 7/2002 | Porter |
| 2005/0178375 | A1 | 8/2005 | Sutherland et al. |
| 2006/0089216 | A1 | 4/2006 | Monteleone |
| 2007/0105668 | A1 | 5/2007 | Kikos |
| 2008/0248903 | A1 | 10/2008 | Cyr et al. |
| 2008/0248904 | A1 | 10/2008 | Cyr et al. |

OTHER PUBLICATIONS

Pages from Red Head, Archery 2008 Specialists Catalog, by: Bass Pro Shops.

Pages from Cabela's 2008 Edition Archery Catalog.

* cited by examiner

REAR MOUNTABLE CUTTER DEVICE FOR A HUNTING ARROW

CROSS REFERENCE TO RELATED APPLICATIONS

The present application claims priority benefit of U.S. Provisional Patent Application No. 61/194,980 filed Oct. 2, 2008.

STATEMENT REGARDING FEDERALLY SPONSORED RESEARCH OR DEVELOPMENT

Not Applicable

BACKGROUND OF THE INVENTION

The present invention pertains to hunting arrows and more specifically, to a rear mountable cutter device or vane assembly that is mountable to the rear end of an arrow shaft.

When hunting with a bow and arrow, it is generally understood that it is desirable to create an entry and an exit wound in a target animal. By creating an entry and exit wound, it is likely that bleeding from the wounds will permit the hunter to track and locate the target animal due to bleeding from the respective wounds. If the entry and exit wounds close quickly, tracking of the wounded animal may become more difficult and the animal may not be able to be located.

To address this problem, hunting arrows have been provided with broad heads at the forward end of the arrow that have cutter blades which deploy upon impact to produce a larger wound than would be produced without the deployable cutter blades. The size of the cutter blades used in a broad head, however, is limited in practice by the size of the broad head. Additionally, if deployed cutter blades at the forward end of an arrow are too large, the broad head will not be as likely to pass through the target animal and create an exit wound.

Accordingly, it would be desirable to have an expandable cutter assembly that is mountable to an arrow and that produces an entry wound larger than that typically produced by a conventional broad head having deployable cutter blades. Additionally, it would be desirable to have an arrow that produces more substantial internal wounds in a target animal to more quickly cause the demise of the target animal. Finally, it would be desirable to have a technique for accurately positioning and mounting vanes to the rear end of an arrow shaft without expensive or complex tooling.

BRIEF SUMMARY OF THE INVENTION

A rear mountable cutter device for a hunting arrow is disclosed. The rear mountable cutter device includes at least one mounting component and a plurality of cutting members which may be provided in the form or wires or blades or as a portion of a stamped metal. The at least one mounting component is configured and adapted for mounting to the back end of a hunting arrow or to a nock that is mountable to the arrow. When the forward end of the cutting members impact a target animal, the cutting members deform or rotate outward from the arrow shaft to produce an enlarged entry wound and more substantial internal wounds than would be created in the absence of the rear mountable cutter blade device.

An alignment tool for use in the installation of a rear mountable cutter blade device and vanes for a hunting arrow is described that provides for accurate mounting of the cutter members and/or vanes to the arrow.

Other features, aspects and advantages of the presently disclosed structures will be apparent to those of ordinary skill in the art from the present disclosure taken in conjunctions with the following Drawings and the Detailed Description of the Invention.

BRIEF DESCRIPTION OF THE SEVERAL VIEWS OF THE DRAWINGS

The invention will be more fully understood by reference to the detailed description of the invention in conjunction with the following drawings of which.

DETAILED DESCRIPTION OF THE INVENTION

U.S. Provisional Application No. 61/194,980 filed Oct. 2, 2008 and titled Rear Mountable Assembly for a Hunting Arrow is incorporated herein by reference in its entirety.

In accordance with the present invention, a rear mountable cutter device for a hunting arrow is described. The rear mountable cutter device includes at least one mounting component configured for mounting a plurality of elongated cutting members at the rearward end of an arrow shaft. The plurality of elongated cutting members have a back end and a forward end. The back end of each of the plurality of elongated members is mechanically coupled to a mounting component. The mechanical coupling may constitute an attachment that fixedly mounts the cutting members to the component, an attachment that permits pivotal rotation of the cutting members with respect to the mounting component. The mechanical coupling may also encompass fabrication of the cutting members as a single piece with a mounting component. Upon mounting of the at least one mounting component to the rearward end of the arrow shaft, the cutting members are oriented in a non-deployed position in which the plurality of elongated cutting members are disposed adjacent the surface of the rear portion of the arrow shaft and generally parallel to the longitudinal axis of the arrow shaft. The cutting members include a forward end and at least the forward end deflects outward from the arrow shaft upon engagement of the forward end of the cutting members with a target.

The at least one mounting component may include a sleeve portion that is formed as a single piece with the cutting members, a nock that is cooperative with the sleeve portion, a nock to which cutting members are pivotably or fixedly attached, an intermediate member to which the cutting members are pivotably or fixedly coupled or any other suitable mounting components for supporting the cutting members as subsequently described.

Figure 1:
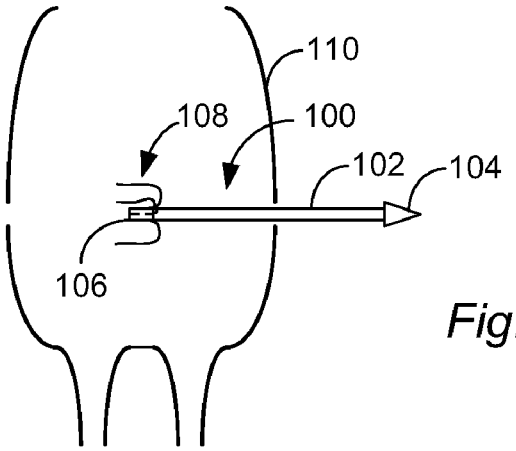
FIG. 1 is a pictorial representation of a hunting arrow having a rear mountable cutter device in accordance with the present invention following penetration of a target animal.

FIG. 1 illustrates the manner of operation of a rear mountable cutter device for a hunting arrow in accordance with the present invention. Referring to FIG. 1, a hunting arrow 100 includes a shaft 102, an arrowhead 104 at the forward end of the shaft 102, a nock 106 at the rear end of the shaft 102, and a rear mountable cutter device 108. The rear mountable cutter device 108 includes a plurality of cutting members that are disposed adjacent the shaft in flight and deploy upon impact with a target animal 110 to enlarge the wounds to the animal 110.

Figure 2:
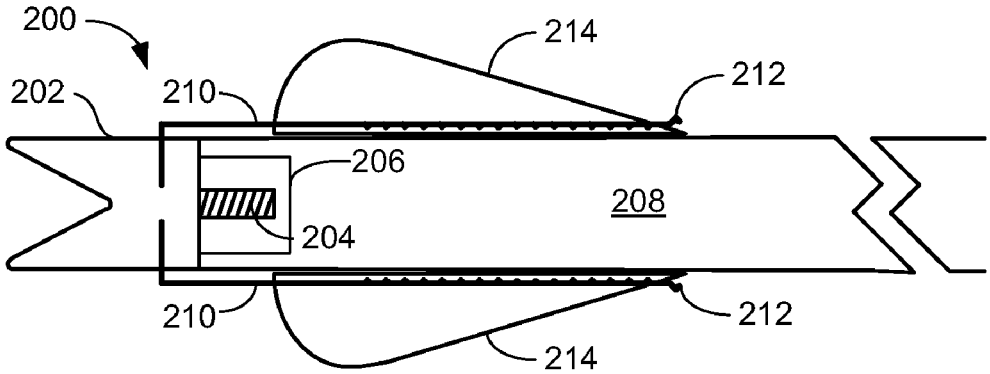
FIG. 2 is a schematic representation of a first embodiment of a rear mountable cutter device in accordance with the present invention.

One embodiment of a rear mountable cutter device adapted for mounting to a hunting arrow is illustrated in greater detail in FIG. 2. Referring to FIG. 2, the rear mountable cutter device 200 includes a nock 202 that includes a male threaded portion 204. The male threaded portion 204 of the nock 202 can be screwed into a female threaded receptacle 206 at the rear end of the arrow shaft 208 to secure the nock 202 to the arrow shaft 208.

A plurality of cutting members 210 are mounted to the nock 202 and extend forward from the nock 202 generally along the shaft 208. The nock 202 may be mounted to the rear end of the arrow shaft 208 via any suitable means. More specifically, while the nock 202 is depicted as including a threaded portion 204 that is screwed into threads at the rear end of the shaft 208, the nock 202 may alternatively include a projection that is press fit into a cooperative recess in the rear end of the arrow shaft. In one embodiment, a female threaded receptacle 206 is provided in the rear end of the arrow shaft and is glued, press fit, crimped in place or otherwise securely mounted to the arrow shaft 208 so that the receptacle 206 is less likely to separate from the arrow shaft 208 when subjected to the forces imparted when the cutting members 210 deploy upon impact with a target animal. The cutting members 210 may be resilient bendable wires or wire-like members that are securely mounted to the nock 202. The wires or wire-like members may be inserted and secured in holes provided in the nock 202 so that they do not become separated from the nock 202 when the wires engage the target animal. The wires or wire-like cutting members may be fabricated out of spring steel or any other suitable material. The wires may also be securely affixed to the nock 202 via welding, peening, crimping, gluing or via any other suitable technique.

At the forward end of each cutting member 210, a barb 212 may be provided. Upon impact with the hide of the target animal, the barbs 212 engage the hide and promote the outward bending of the cutting members 210. The cutting members 210 may be provided with sharpened or serrated edges to promote cutting of the animal hide and slitting of the internals of the animal as the cutter device 200 penetrates the hide and the internals of the animal. In the present disclosure, only two (2) cutting members and two (2) vanes are depicted for simplicity, although typically, three (3) cutting members 210 and three (3) vanes 214 are employed symmetrically spaced around the arrow shaft. The vanes 214 are disposed longitudinally along the arrow shaft and typically offset from one another by 120 degrees.

Figure 3:
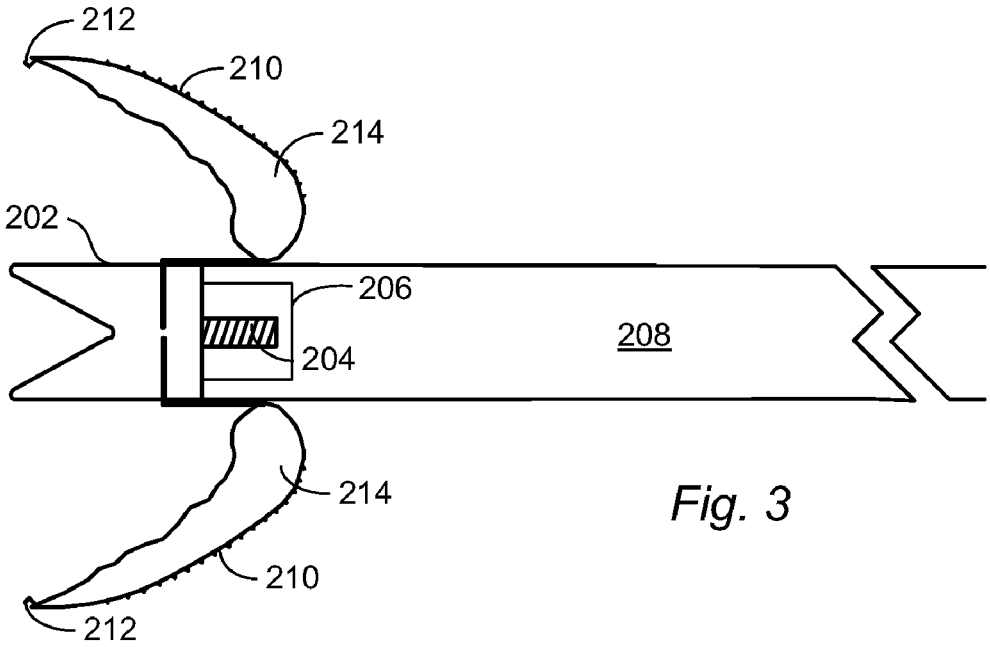
FIG. 3 is a schematic representation of the embodiment of FIG. 2 following deployment of the cutting members of the rear mountable cutter device.

FIG. 3 illustrates the rear mounted cutter device of FIG. 2 following deployment of the cutting members 210. As depicted in FIG. 3, the cutting members 210, upon engagement with the target animal, deform outward so as to create an enlarged entry wound and increased damage to the internals of the target animal. Depending upon the configuration of the vanes 214, the vanes 214 may or may not deploy with the cutter members 210.

Figure 4:
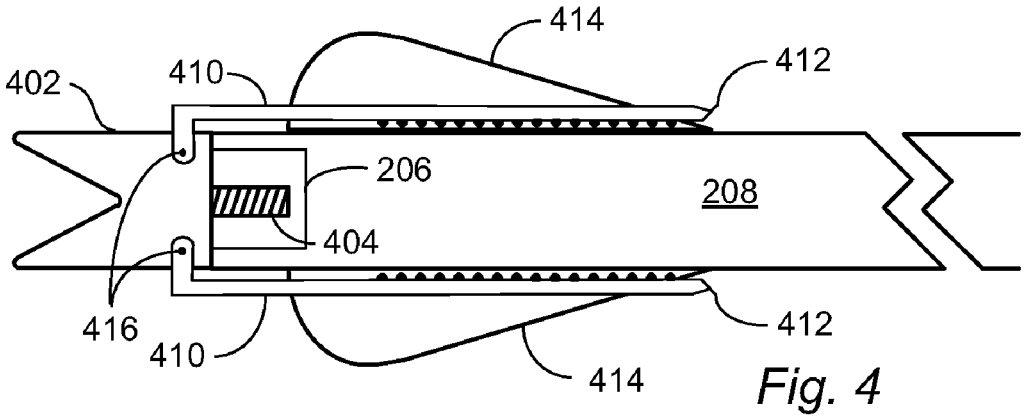
FIG. 4 is a schematic representation of a second embodiment of a rear mountable cutter device in accordance with the present invention.

In another embodiment illustrated in FIG. 4, cutting members 410 are provided in the form of elongated blades that are pivotally mounted to a nock 402 via pivot pins 416. The cutting members 410 are provided with a sharpened and/or serrated edge that generally abuts the arrow shaft 208 in a first non-deployed position and rotate outward upon engagement of the forward end of the respective blades with the target animal. The nock 402 includes a forward extending male threaded portion 404 that may be screwed into the threaded female receptacle 206 provided at the back end of the arrow shaft 208. The cutting members 410 are configured so as to have a positive stop limit on the pivotal rotation of the cutting members 410. The positive stop may be provided by an abutment surface on the nock that limits the outward rotation of the cutting members 410. By limiting the pivotal rotation of the cutting members 410, the sharpened edges of the cutting members 410 are maintained in a forward facing direction as the rear mounted cutter device enters the target animal. The forward end of the cutting members 410 may be provided with a barb 412 to facilitate deployment of the cutting members 410 upon engagement with the target animal. Vanes 414 are provided to stabilize the arrow in flight. The blades may be fabricated of steel or any other suitable material. The manner of attachment of the vanes 414 is subsequently discussed in greater detail.

Figure 5:
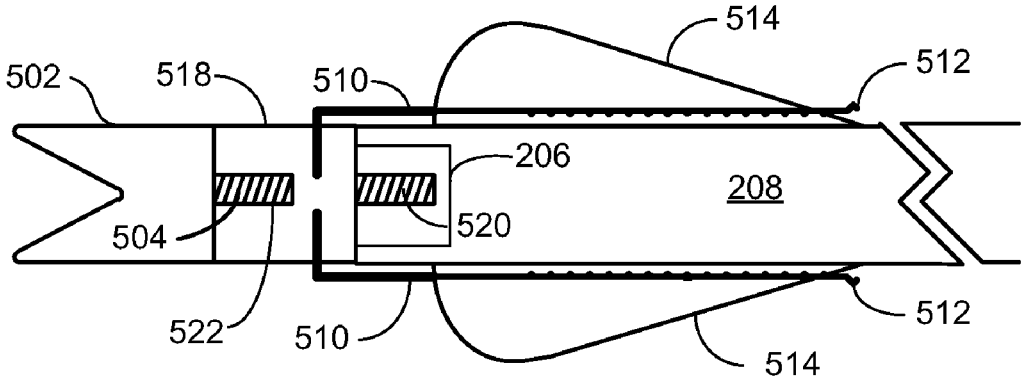
FIG. 5 is a schematic representation of a third embodiment of a rear mountable cutter device in accordance with the present invention.

In another embodiment illustrated in FIG. 5, a generally cylindrical intermediate member 518 is secured between a nock 502 and the arrow shaft 208. Cutter members 510 in the form of resilient bendable wires or wire-like members are securely mounted to the intermediate member 518 and extend forward along the arrow shaft 208 as discussed above in connection with FIG. 2 upon securing of the intermediate member 518 to the arrow shaft 208. The intermediate member 518 includes a male threaded portion 520 that may be screwed into a threaded female receptacle 206 at the rear end of the arrow shaft 208. A female threaded opening 522 is provided at the back end of the intermediate member 518 to receive a threaded portion 504 extending from the forward end of the nock 502. Upon screwing the threaded portion 504 of the nock 502 into the threaded opening 522 of the intermediate member 518 and upon screwing the threaded portion 520 of the intermediate member 518 into the threaded receptacle 206 at the rear end of the arrow shaft 208, the cutting members 510 are securely mounted to the rear end of the arrow shaft 208. The cutting members 510 may include sharpened and/or serrated edges as discussed above. Barbs 512 may be provided at the forward end of the cutting members 510 to promote outward bending of the cutting members 510 upon engagement of the barbs 512 with the target animal. While the intermediate member 518 is described as being secured to the nock 502 and the arrow shaft 208 via threaded connections, it may alternatively be secured to the arrow shaft 208 and the nock 402 via projections that are press fit into cooperative receptacles or openings, or via any other suitable attachment technique. The cutting members 510 may be fabricated out of spring steel or any other suitable material. Vanes 514 are provided to stabilize the arrow in flight.

Figure 6:
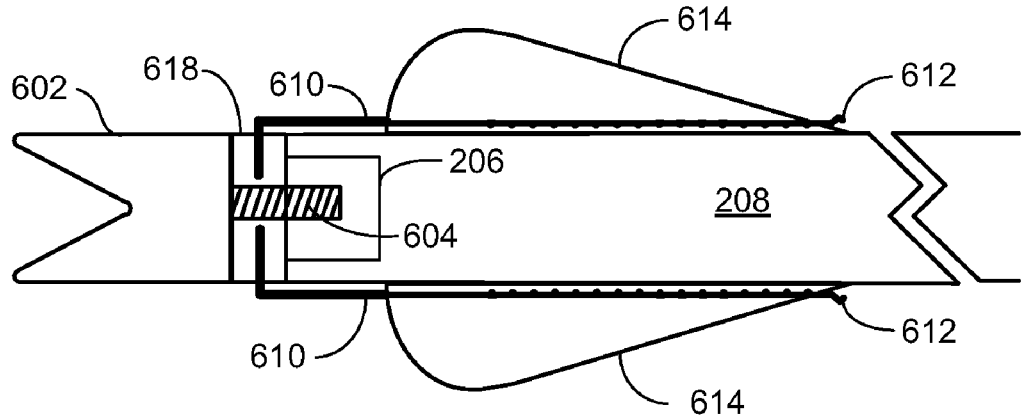
FIG. 6 is a schematic representation of a fourth embodiment of a rear mountable cutter device in accordance with the present invention.

In another embodiment illustrated in FIG. 6, cutting members 610 are mounted to a washer or generally donut shaped intermediate member 618 having a central opening therethrough. A nock 602 includes a threaded projection 604 that extends from the forward end of the nock 602. To secure the washer-like intermediate member 618 and the cutting members 610 attached thereto to the rear end of the arrow shaft 208, the threaded projection 604 is inserted through the opening in the washer-like intermediate member 618 and the projection 604 is threaded into a cooperative receptacle 206 in the rear end of the arrow shaft 208. Following securing of the washer-like member intermediate member 618 between the nock 602 and the arrow shaft 208, the cutting members 610 are disposed in a mounting position extending forward longitudinally along the surface of the rear portion of the arrow shaft 208. The cutting members 610 illustrated in FIG. 6 are as described in connection with the discussion of the cutting members 210 in FIG. 2 and may be secured to the intermediate member 618 via welding to the member 618, insertion in holes in the member 618 and thereafter welding or crimping, or via any other suitable technique. The cutting members 610 may include barbs 612 at the forward end thereof to facilitate deployment of the cutting members 610 upon engagement with a target animal. Vanes 614 are provided to stabilize the arrow in flight.

Figure 7:
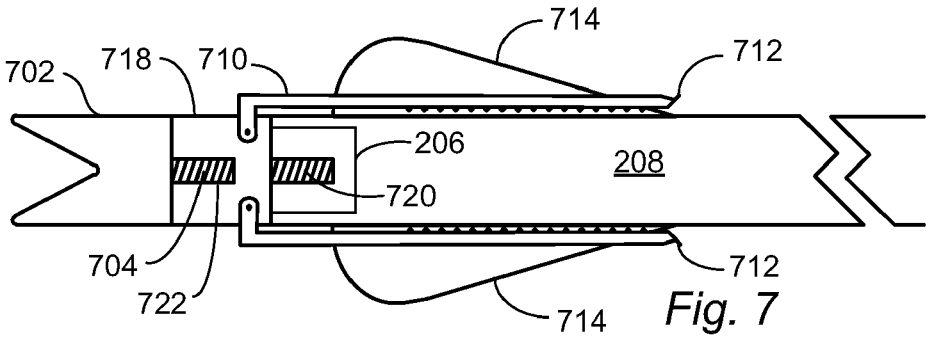
FIG. 7 is a schematic representation of a fifth embodiment of a rear mountable cutter device in accordance with the present invention.

In another embodiment illustrated in FIG. 7, an intermediate member 718 having a threaded opening 722 at the rear end of the intermediate member 718 and a threaded projection 720 extending from the forward end of the intermediate member 718 is mountable between a nock 702 and the rear end of the arrow shaft 208. More specifically, a threaded projection 704 extending from the forward end of the nock 702 may be screwed into the threaded opening 722 in the rear end of the intermediate member 718 to secure the nock 702 to the intermediate member 718 and the threaded projection 720 extending from the forward end of the intermediate member 718 may be threaded into a threaded receptacle 206 at the rear end of the arrow shaft 208 to secure the intermediate member 718 between the nock 702 and the arrow shaft 208. Cutting members 710 in the form of blades are pivotally mounted to intermediate member 618 and are generally as described with respect to the cutting members 410 in FIG. 4. Vanes 714 are provided to stabilize the arrow in flight.

Figure 8:
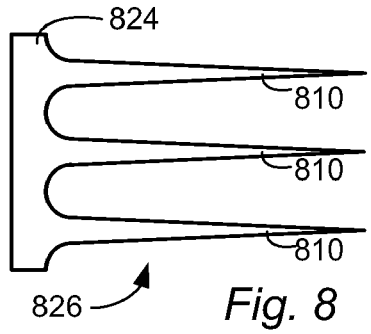
FIG. 8 is an illustration of a cutter piece prior to forming of the piece into its final generally tubular configuration.
Figure 9:
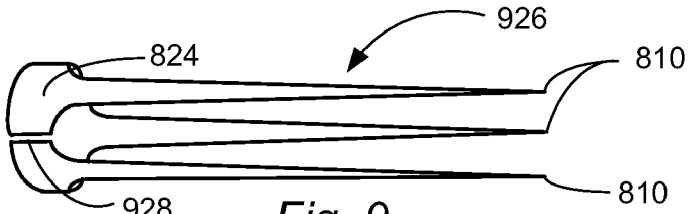
FIG. 9 is an illustration of the cutter piece of FIG. 8 after forming of the cutter piece into its final generally tubular configuration.

In further embodiments depicted in FIGS. 8-11, the cutting members are formed of spring steel or any other suitable material that is stamped or cut to the desired shape. More specifically, referring to FIG. 8, the cutting members 810 are formed with a sleeve portion 824 as a single cutter piece 826. The cutting members 810 are generally triangular and taper from a base adjacent to the sleeve portion to a point at the forward end of the cutting member 810. A crease or dimple may be provided in the cutting members 810 near the forward end to slightly space the forward end of the cutting members 810 from the arrow shaft. The cutter piece 826 is rolled or otherwise formed to provide a generally tubular and crown-like cutter piece 926 having a seam 928 as illustrated in FIG. 9. By way of example and not limitation, the cutter piece 826 may be fabricated of a spring steel having a thickness between 0.010 and 0.083 inches or any other suitable deformable material of appropriate thickness and deformability. The length of the cutting members 810 are typically in the range of 1.5-4.75 inches. In the illustrated embodiment, three cutting members 810 are provided. The edges of the cutting members 810 may be sharpened and/or serrated.

Figure 10:
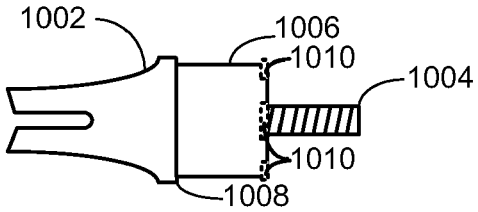
FIG. 10 is a side view of a nock for use with the cutter piece of FIG. 9.

As illustrated in FIG. 10, a nock 1002 is configured for mounting of the cutter piece 926 to the back end of a hunting arrow. More specifically, the nock 1002, includes a cylindrical section 1006 forward of the notched bow string receiving section. The diameter of the cylindrical section 1006 is equal to or slightly greater than the diameter of the arrow shaft 208 with which the cutter piece 926 is intended to be used. At the back end of the cylindrical section 1006 a lip 1008 is provided to prevent the sleeve portion 824 of the cutter piece 926 from sliding backward upon engagement of the cutter piece 926 with a target animal. At the forward end of the nock 1002, a threaded projection 1004 is provided which is threadable into a cooperative threaded receptacle in the back end of an arrow. The inside diameter of the sleeve portion 824 of the cutter piece 926 is slightly less than or equal to the diameter of the cylindrical section 1006 of the nock 1002 to permit the cutter piece 926 to be snugly slidably disposed over the cylindrical section 1006. The seam 928 in the sleeve portion of the cutter piece 928 may be welded via any suitable technique to add increased strength and rigidity to the sleeve portion of the cutter piece 926. An optional ridge of tabs 1010 may be provided at the forward end of the cylindrical section 1006 of the nock 1002 to prevent the cutter piece 926 from sliding forward during assembly and arrow transport.

Figure 10A:
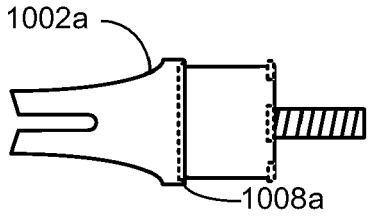
FIG. 10*a* is a side view of an alternative embodiment of a nock for use with the cutter piece of FIG. 9.

A variation of the nock design of FIG. 10 is illustrated in FIG. 10*a*. More specifically, instead of a lip that is generally orthogonal to the surface of the cylindrical section 1006 (FIG. 10), the nock 1002*a* depicted in FIG. 10*a* includes a recessed and angled lip into which the sleeve section 824 of the cutter piece 926 is seated. More specifically, the lip extends outward and forward to provide a slight recess into which the sleeve portion of the cutting piece 926 is seated when disposed over the cylindrical section of the nock 1002*a*.

Figure 11:
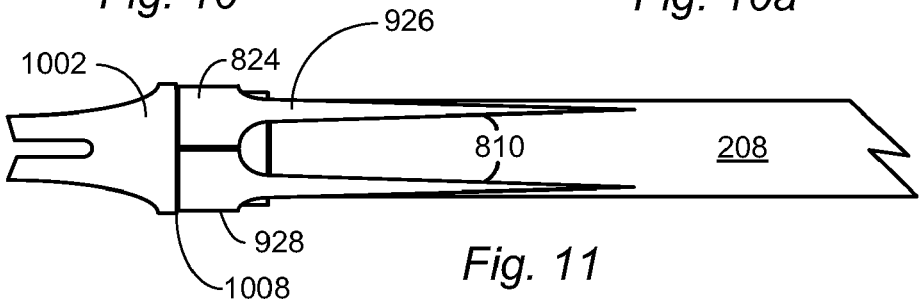
FIG. 11 is a side view illustrating a rear mountable cutter assembly employing the cutter piece of FIG. 9 after mounting to the rearward end of an arrow shaft.

To secure the cutter piece 926 to a hunting arrow, the cutter piece 926 is slidably disposed over the cylindrical section 1006 of the nock 1002 with the back end of the sleeve portion 824 abutting the lip 1008 of the nock 1002, as depicted in FIG. 11. The inner diameter of the sleeve portion 824 is specified to provide a snug or interference fit with the cylindrical section 1006 of the nock. The threaded projection 1004 is threaded into a cooperative threaded receptacle at the back end of the arrow 208 to secure the nock 1002 to the arrow 208 such that the cutting members 810 extend forward toward the arrow head and generally adjacent to the arrow shaft. Alternatively, the nock 1002*a* (FIG. 10*a*) may be employed. Vanes are affixed to the arrow shaft as described below.

The cutting members described hereinabove in FIGS. 1-7 and 9 and 11 may be disposed within or under vanes and the vanes may be adhered to the arrow shaft via use of an adhesive, glue or any other suitable bonding agent with the forward end of the cutting members optionally bent or formed so as provide a barb-like member that angles slightly outward and forward from the arrow shaft 208 when the rear mounted cutter device is mounted to the arrow shaft 208. The vanes discussed hereinabove with respect to FIGS. 1-7 and 11 may be mounted to the arrow shaft via use of a glue, adhesive or a bonding agent that releases as the cutting members impact the target. When the vanes are disposed over the cutting members, the adhesion of the adhesive, glue or other bonding agent is specified so as to retain the vanes and cutting members in place during physical transport of the arrow, arrow release and arrow flight while permitting the vanes and cutting members to peel away upon engagement of the cutting member with the target animal. In one embodiment, the cutting members may be disposed within a vane fabricated from first and second opposing portions and the cutting members, upon impact with the target animal, deflect away from the arrow shaft 208 and out of the vane while the vanes remain adhered to the arrow shaft. The opposing portions of each vane may be i) adhered or glued to one another, 2) physically attached to one another via engagement members on the respective vanes, 3) thermal welding to one another or 4) joined via any other suitable technique. The cutting members may also be disposed in a recess provided in the underside of each vane. Alternatively, the cutting members may be positioned in longitudinal openings provided within the respective vanes. The vanes may also be molded around the cutting members.

The cutting members may also be disposed between the respective vanes and maintained in place via a suitable o-ring or elastic member which surrounds the forward end of the cutting members to retain the cutting members in place between the respective vanes while the arrow is in flight. It should be noted that this embodiment may not be suited for use with bows having a hard rest that would cause the rear cutting members to deploy upon arrow release.

Figure 12:
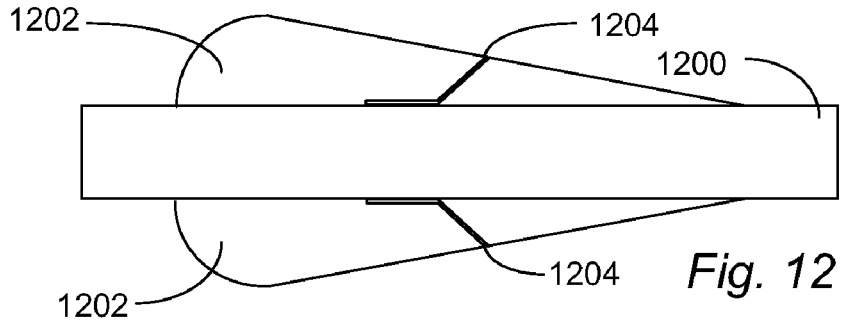
FIG. 12 is a side view depicting vanes mounted to a section of heat shrink tubing.
Figure 13:
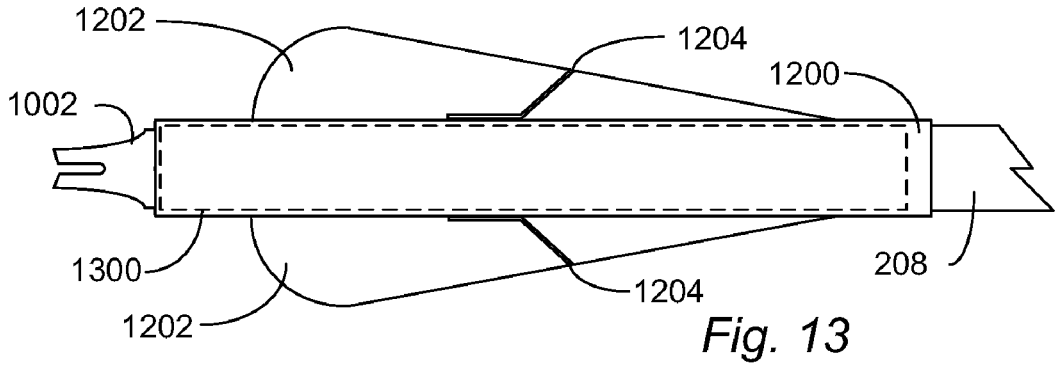
FIG. 13 is a side view illustrating the vanes and heat shrink tubing of FIG. 12 mounted over the cutting members disposed along the rear portion of the arrow shaft.

In one embodiment, the cutting members may be secured to the shaft via the use of heat shrink tubing as illustrated in FIGS. 12 and 13. A section of heat shrink tubing 1200 having vanes 1202 affixed thereto is illustrated in FIG. 12. While in the illustrated embodiment, the vanes 1202 are affixed to the section of heat shrink tubing 1200 prior to the mounting of the heat shrink tubing 1200 over the cutting members, it should be recognized that the vanes 1202 may be secured to the heat shrink tubing following mounting of the heat shrink tubing 1200 over the cutting members. After the heat shrink tubing is slidably disposed over the cutting members, heat is applied to the heat shrink tubing to secure the cutting members under the tubing. Prior to mounting of the heat shrink tubing, the cutting members 810 (or 810*a*) in one embodiment, splay outward from the mounting component(s) while extending toward the forward end of the arrow shaft. Following the shrinking of the heat shrink tubing over the cutting members, the cutting members are disposed generally parallel to the longitudinal axis of the arrow shaft. Following mounting of the vanes 1202 and the heat shrink tubing 1200 to the rear portion of the arrow shaft 208, the cutting members are generally covered by the heat shrink tubing 1200 as illustrated in FIG. 13.

The vanes 1202 may include a stiffening member 1204 that is molded as an integral part of the respective vanes 1202. Alternatively, the vanes 1202 may be configured to receive a metal or plastic stiffening member and is mounted to the vane. The stiffening members 1204 are configured to engage the target animal upon impact and peel the section of heat shrink tubing 1200 off of the back end of the arrow shaft 208. In one embodiment, the forward ends of the cutting members are disposed under the forward edge of the heat shrink tubing. In this embodiment, once the heat shrink tubing peels off of the rear portion of the arrow shaft upon impact with a target animal, the cutting members tend to return to their normally splayed out position promoting engagement of the cutting members with the target animal internals. In another embodiment, the forward ends of the cutting members extend slightly beyond the forward edge of the heat shrink tubing so that the forward edge of the cutting members is more likely to engage the target animal and deflect the cutting members outward upon engagement with the animal.

Figure 8A:
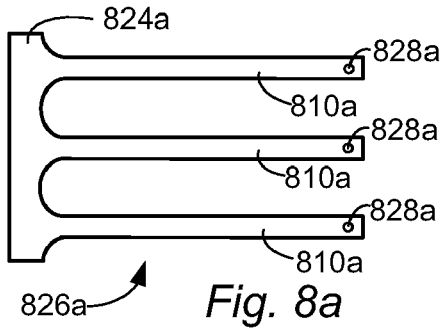
FIG. 8*a* is an alternative embodiment of the cutter piece of FIG. 8.

While the cutting members 810 illustrated in FIG. 8 are generally triangular, cutting members 810*a* may be generally rectangular as depicted in FIG. 8*a*. Additionally, a dimple 828*a* or crease may be provided near the forward end of the cutting members 810*a* to slightly space the cutting members 810*a* from the arrow shaft when the cutting members are disposed in their final mounting position adjacent the arrow shaft.

As illustrated in FIG. 13, a generally cylindrical tube 1300 may optionally be slidably disposed over the cutting members of any of the foregoing embodiments. The section of heat shrink tubing 1200 is disposed over the cylindrical tube 1300 and heat is applied to the heat shrink tubing 1200 to shrink the heat shrink tubing 1200 around the cylindrical tube 1300 following mounting of the rear mounted cutter device to the rear end of the arrow shaft 208. Upon shrinking of the heat shrink tubing 1200, the tubing 1200 takes the shape of the underlying cylindrical tube 1300 along the length of the cylindrical tube 1300. The length of the cylindrical tube 1300 is typically specified so as to extend generally from the lip 1008 of the nock 1002 or slightly rearward of the lip (FIG. 11) to the forward end of the cutting members, so that the forward end of the cylindrical tube 1300 covers the forward end of the cutting members (e.g. 810) (FIG. 11). The diameter of the nock 1002 at the lip 1008 is less than the inside diameter of the cylindrical tube 1300 to permit the cylindrical tube 1300 to slide over the nock 1002. The heat shrink tubing 1200 extends slightly forward of the forward end of the cylindrical tube 1300 such that upon the application of heat, the heat shrink tubing 1200 shrinks around the arrow shaft 208 at the forward end of the heat shrink tubing 1200 to secure the vanes 1202 in place for transit and arrow flight. For example, and not by way of limitation, the heat shrink tubing 1200 may extend ⅛th inch to ½ inch beyond the forward edge of the cylindrical tubing 1300. Additionally, the heat shrink tubing 1200 may extend ⅛th inch to ½ inch rearward of the rear end of the cylindrical tube 1300. The cylindrical tube 1300 is a semi-rigid tube that may be fabricated of plastic, paper or any other suitable material. When the cylindrical tube 1300 is employed, upon engagement of the stiffening members 1204 with a target animal, the heat shrink tubing 1200, vanes 1202 and cylindrical tube disengage from the rear portion of the arrow shaft 208 permitting the cutting members to deploy. The diameter of the cylindrical tubing 1300 and the distance that the heat shrink tubing 1200 extends beyond the forward edge of the cylindrical tubing 1300 are selected to achieve reliable deployment of the cylindrical tubing 1300, the heat shrink tubing 1200 and the vanes 1202 upon engagement of the vanes 1202 and the stiffening member 1204 with the target animal.

In another embodiment, vanes are mechanically coupled to a mounting member and the mounting member is mounted to the back end of the arrow to position the vanes along the rear of the arrow shaft. Such a version is generally similar to the versions depicted in FIGS. 2, 5, and 6 employing the mounting members described above, but would not utilize cutting members. Additionally, vanes in this embodiment are intended to remain affixed to the arrow shaft so a strong adhesive may be employed. In this embodiment, the vanes may be coupled to the mounting member via a thin wire, a plastic member or any other suitable coupling member. Additionally, the vanes and the mounting member may be formed as a unitary molded piece. The vanes are aligned along the arrow shaft or along a section of heat shrink tubing and an adhesive or glue is employed to adhere the vanes to the arrow shaft or tubing in proper alignment. Additionally, an adhesive having a peel and release sheet may be adhered to the arrow shaft, tubing or the base of the vanes and the release sheet removed prior to mounting of the vanes to the arrow shaft or tubing, as applicable.

Figure 14:
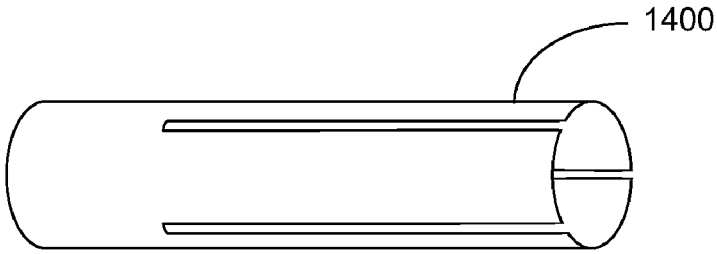
FIG. 14 is a perspective view of an alignment tool for use in the mounting of vanes to an arrow shaft.
Figure 15:
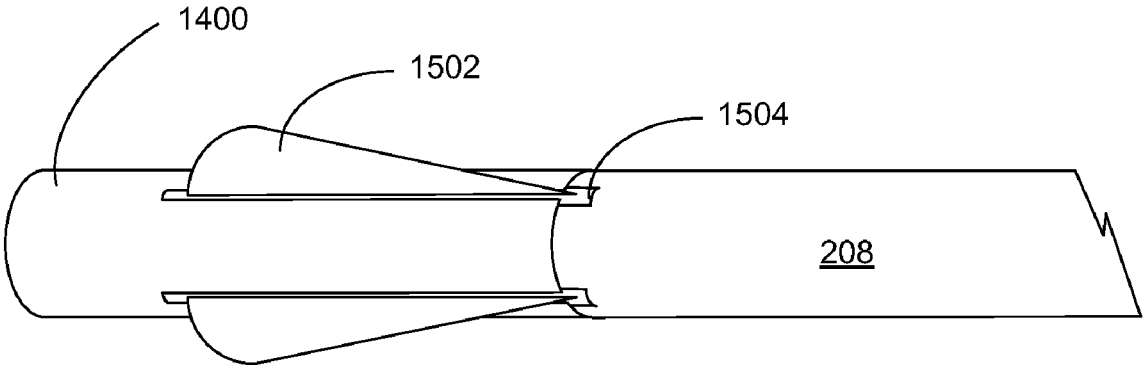
FIG. 15 is a perspective view illustrating the use of the alignment tool of FIG. 12 for the mounting of vanes to an arrow shaft.

To achieve proper alignment of the vanes and cutting members, a slotted tube 1400 such as depicted in FIG. 14 may be employed. Referring to FIG. 15, vanes 1502 include a flat or slightly curved base 1504. The vanes 1502 are affixed to the arrow shaft 208 via use of an adhesive. A slow curing adhesive may be employed to allow the vanes to be positioned using the alignment tool 1400. Alternatively, the base 1504 of each vane 1502 may have an adhesive release sheet affixed thereto. Upon removal of the release sheet and the application of pressure, the vanes 1502 may be affixed to rear portion of the arrow shaft 208 in the desired position while the tool 1400 assures proper alignment of the vanes 1502. It should be noted that if the mounting member comprises a nock to which the vanes are mechanically coupled, the nock may have a projection that is press fit or threaded into a cooperative recess in the rear end of the arrow. The above-described tool may be employed to achieve alignment of the vanes in the above-described embodiments whether or not cutting members are employed. It should be recognized that the diameter of the alignment tool 1400 will need to be specified to permit slidable disposal over the vanes or the vanes and cutting members, as applicable.

It will be appreciated by those of ordinary skill in the art that variations of and modifications to the above described rear mountable cutter device and rear mountable vane assembly may be made without departing from the inventive concepts disclosed herein. Accordingly, the invention is not to be viewed as limited except by the scope and spirit of the appended claims.

What is claimed is:

1. A rear mountable cutter device for a hunting arrow having an arrow shaft with a rear portion terminating in a rearward end, said arrow shaft having a longitudinal axis and a forward end, the cutter device comprising:

at least one mounting component configured for secure attachment to the rearward end of the arrow shaft to prevent detachment of the at least one mounting component from the arrow shaft upon engagement of the cutter device with a target; and at least one cutter piece having a back end, said back end of the at least one cutter piece being coupled to the at least one mounting component, said at least one cutter piece including at least one elongated cutting member having a forward end, said at least one elongated cutting member extending from the rearward end of the arrow shaft toward the forward end of the arrow shaft in a non-deployed position following coupling of the at least one cutter piece to the at least one mounting component, at least said forward end of the at least one elongated cutting member movable from said non-deployed position outward upon engagement of the forward end of the at least one elongated cutting member with the target.

2. The device of claim 1 wherein said at least one cutter piece comprises a single cutter piece that includes a generally tubular sleeve portion and a plurality of elongated cutting members extending from the sleeve portion toward the forward end of the arrow shaft when the cutter piece is coupled to the at least one mounting component, wherein the plurality of elongated cutting members and the sleeve portion are formed as a single piece.

3. The device of claim 2 wherein at least one of said plurality of elongated cutting members has at least one edge that is sharpened or serrated.

4. The device of claim 1 wherein said at least one elongated cutting member comprises three elongated cutting members.

5. The device of claim 2 wherein said at least one mounting component includes a nock having a rearward end, a front end, a generally cylindrical section having a rearward end and a front end, and an outward extending lip at the rearward end of the cylindrical section, wherein the generally tubular sleeve portion has an inside diameter sized for a snug fit over the cylindrical section of the nock, the sleeve portion being slidably disposed over the cylindrical section of the nock with a rearward end of the sleeve portion in abutting relation with the outward extending lip of the nock, the nock including a projection that is cooperative with a receptacle in the rearward end of the arrow shaft to secure the nock and the plurality of elongated cutting members in the non-deployed position.

6. The device of claim 2 wherein the plurality of elongated cutting members are tapered to form a point at the front end of the respective elongated cutting members.

7. The device of claim 2 wherein the plurality of elongated cutting members are generally rectangular.

8. The device of claim 5 wherein said nock further includes a lip or tab extending outward from the front end of the cylindrical section to limit forward movement of the cutter piece upon mounting of the sleeve portion of the cutter piece on the cylindrical section of the nock.

9. The device of claim 1 further including a tube disposed at least partially over the at least one cutter piece and a plurality of vanes affixed to the tube.

10. The device of claim 1 further including a tube disposed at least partially over the at least one elongated cutting member, the tube maintaining at least a portion of the at least one elongated cutting member in generally abutting relation with the rear portion of the arrow shaft prior to engagement of the at least one elongated cutting member with the target.

11. The device of claim 1 wherein said at least one mounting component includes a nock and said at least one cutter piece is mechanically coupled to the nock.

12. The device of claim 11 wherein said at least one cutter piece includes a plurality of wire-like elongated cutting members mounted to the nock.

13. The device of claim 11 wherein said at least one cutter piece comprises a plurality of blades pivotably coupled to the nock.

14. The device of claim 11 further including a tube disposed at least partially over the at least one cutter piece and a plurality of vanes affixed to the tube.

15. The device of claim 11 further including a plurality of vanes disposed adjacent the rearward end of the arrow shaft and over the at least one cutter piece, the vanes having a base section configured for adhesive mounting to the rear portion of the arrow shaft.

16. The device of claim 1 wherein said at least one mounting component includes a nock and said cutter piece includes an intermediate member having a rearward end and a front end, said at least one elongated cutting member being mounted to said intermediate member, said intermediate member configured for mounting to the rearward end of the arrow shaft between the nock and the rearward end of the arrow shaft.

17. The device of claim 16 wherein the intermediate member includes a projection extending from the front end of the intermediate member, said projection cooperative with a receptacle in the rearward end of the arrow shaft to secure the intermediate member to the rearward end of the arrow shaft.

18. The device of claim 16 wherein said at least one elongated cutting member includes a plurality of elongated cutting members.

19. The device of claim 16 wherein said at least one elongated cutting member includes a plurality of blades having a rearward end and a forward end, the rearward end of the plurality of blades being pivotably coupled to the intermediate member to permit outward rotation of the blades upon engagement of the forward end of the blades with a target.

20. The device of claim 16 further including a tube disposed over the at least one cutter piece and a plurality of vanes affixed to the tube.

21. The device of claim 16 further including a plurality of vanes disposed over the at least one elongated cutting member, the vanes having a base section configured for adhesive mounting to the rear portion of the arrow shaft.

22. The device of claim 16 wherein said intermediate member includes a generally cylindrical member having an opening therethrough and said at least one cutter piece comprises a plurality of wires affixed to said generally cylindrical member.

23. The device of claim 22 wherein said at least one mounting component includes a nock having a front end and a projection extending from the front end of the nock, said projection extending through said opening in said generally cylindrical member and cooperative with a receptacle in the rearward end of the arrow shaft to secure the generally cylindrical member and the nock to the arrow shaft.

24. The device of claim 22 further including a tube disposed at least partially over the plurality of wires and a plurality of vanes affixed to the tube.

25. The device of claim 22 further including a plurality of vanes disposed over the plurality of wires, the vanes having a base section configured for adhesive mounting to the rear portion of the arrow shaft.

26. A rear mountable cutter device for a hunting arrow having an arrow shaft with a rear portion terminating in a rearward end, said arrow shaft having a longitudinal axis and a forward end, the cutter device comprising:

a mounting component configured for secure attachment to the rearward end of the arrow shaft to prevent detachment of the at least one mounting component upon engagement of the cutter device with a target; and a cutter piece having a back end and a forward end, the back end of the cutter piece being coupled to the mounting component, the cutter piece including a plurality of elongated cutting members extending from the back end of the cutter piece toward the forward end of the arrow shaft in a non-deployed position following coupling to the mounting component, at least said forward end of the plurality of cutting members movable outward from said non-deployed position upon engagement of the forward end of the cutting members with the target.

27. The device of claim 26 wherein the cutter piece includes a generally tubular sleeve portion and the plurality of elongated cutting members extend from the sleeve portion toward the forward end of the arrow shaft when the cutter piece is coupled to the mounting component, wherein the plurality of elongated cutting members and the sleeve portion are formed as a single piece.

28. The device of claim 27 wherein the mounting component includes a nock having a rearward end, a front end, a generally cylindrical section having a rearward end and a front end, and an outward extending lip at the rearward end of the cylindrical section, wherein the generally tubular sleeve portion has an inside diameter sized for a snug fit over the cylindrical section of the nock, the sleeve portion being slidably disposed over the cylindrical section of the nock with a rearward end of the sleeve portion in abutting relation with the outward extending lip of the nock, the nock including a projection that is cooperative with a receptacle in the rearward end of the arrow shaft to secure the nock and the cutter piece mounted thereon to the rearward end of the arrow shaft.

29. The device of claim 26 further including a tube disposed over the cutter piece, the tube maintaining the plurality of elongated cutting members in generally abutting relation with the rear portion of the arrow shaft when the cutter piece is coupled to the mounting component.

30. A rear mountable cutter device for a hunting arrow having an arrow shaft with a forward end, a longitudinal axis and rearward portion terminating in a rearward end, the rear mountable cutter comprising:

a cutter component having a rearward portion and a forward end, the cutter component including at least one elongated cutting member that extends from the rearward portion of the cutter component to the forward end of the cutter component;

at least one mounting component, the rearward portion of the cutter component being coupled to the at least one mounting component, the at least one mounting component being configured for secure mounting to the rearward portion of the arrow shaft to prevent detachment of the at least one mounting component from the rearward portion of the arrow shaft upon engagement of the at least one elongated cutting member with a target; and a tube disposed over at least a first portion of the at least one elongated cutting member to maintain the first portion of the at least one elongated cutting member in generally abutting relation with the arrow shaft in a non-deployed orientation in advance of the engagement of the at least one elongated cutting member with the target, wherein at least a second portion of the at least one elongated cutting member is movable outward from the arrow shaft upon engagement of the at least one elongated cutting member with the target.

31. The rear mountable cutter device of claim 30 wherein the at least one mounting component includes a nock that is securely mountable to the rearward portion of the hunting arrow.

32. The rear mountable cutter device of claim 31 wherein the nock includes a threaded stud and the nock is securely mountable to the rearward portion of the arrow shaft upon threadable engagement of the threaded stud with a cooperative threaded receptacle provided in the rearward portion of the arrow shaft.

33. The rear mountable cutter device of claim 31 wherein the cutter component includes a sleeve at the rearward portion of the cutter component, the nock includes a sleeve receiving section configured to slidably receive the sleeve, and wherein the sleeve is slidably disposed over the sleeve receiving section of the nock.

34. The rear mountable cutter device of claim 33 wherein the at least one elongated cutting member is formed as a single piece with, and extends from, the sleeve.

35. The rear mountable cutter device of claim 33 wherein the cutter component includes three elongated cutting members that are formed as a single piece with, and extend from, the sleeve.

36. The rear mountable cutter device of claim 30 wherein the at least one mounting component includes an intermediate member, the intermediate member having a rearward end configured for coupling to a nock and a front end configured for coupling to the rearward portion of the arrow shaft.

37. The rear mountable cutter device of claim 30, wherein the at least one mounting component includes a washer-like intermediate member having a central opening, the washer-like intermediate member being mountable between the rearward portion of the arrow shaft and a nock.

38. The rear mountable cutter device of claim 37, further including the nock, the nock including a stud extending through the central opening and cooperative with a receptacle in the rearward portion of the arrow shaft for secure mounting of the washer-like intermediate member to the rearward portion of the arrow shaft.

39. The rear mountable cutter device of claim 30 wherein the at least one elongated cutting member has a length between 1.5 and 4.75 inches.

40. The rear mountable cutter device of claim 30 further including a plurality of vanes extending outward from the tube.

41. A kit comprising components of a rear mountable cutter device for mounting to an arrow shaft having a longitudinal axis, a forward end and a rearward portion terminating in a rearward end, the kit comprising:

a cutter component having a rearward portion and a forward end, the cutter component including at least one elongated cutting member that extends from the rearward portion of the cutter component to the forward end of the cutter component;

at least one mounting component, the rearward portion of the cutter component being coupleable to the at least one mounting component, the at least one mounting component being configured for secure mounting to the rearward portion of the arrow shaft to prevent detachment of the at least one mounting component from the rearward portion of the arrow shaft upon engagement of the at least one elongated cutting member with a target; and a tube disposable over at least a first portion of the at least one elongated cutting member to maintain the first portion of the at least one elongated cutting member in generally abutting relation with the arrow shaft in a non-deployed orientation in advance of the engagement of the at least one elongated cutting member with the target, wherein at least a second portion of the at least one elongated cutting member is movable outward from the arrow shaft upon engagement of the at least one elongated cutting member with the target.

42. The kit of claim 41 wherein the at least one elongated cutting member has a length between 1.5 and 4.75 inches.

43. The kit of claim 41 wherein the tube includes a plurality of vanes extending outward therefrom.

* * * * *